US005474003A

United States Patent [19]

Tippmann

[11] Patent Number: 5,474,003

[45] Date of Patent: Dec. 12, 1995

[54] PNEUMATIC SEWING MACHINE

[76] Inventor: Dennis J. Tippmann, 12708 Parent Rd., New Haven, Ind. 46774

[21] Appl. No.: 231,918

[22] Filed: Apr. 25, 1994

[51] Int. Cl.[6] ..... D05B 69/08; D05B 55/14

[52] U.S. Cl. ..... 112/221; 112/276; 112/DIG. 3

[58] Field of Search ..... 112/221, 220, 112/276, DIG. 3

[56] References Cited

U.S. PATENT DOCUMENTS

| | | | |
|---|---|---|---|
| 3,688,713 | 9/1972 | McKeen | 112/221 X |
| 3,913,508 | 10/1975 | Boser | 112/221 |
| 4,343,251 | 8/1982 | Goldbeck et al. | 112/221 |
| 4,414,909 | 11/1983 | Bray | 112/221 X |
| 4,690,081 | 9/1987 | Castagna et al. | 112/220 X |

*Primary Examiner*—Peter Nerbun
*Attorney, Agent, or Firm*—Joseph J. Baker

[57] ABSTRACT

A pneumatic sewing machine having a housing mounting a presser foot and needle bar for reciprocatory movement and a bobbin for rotary movement, a rocker arm pivotably mounted on the housing having one end attached to the needle bar and the other attached to a pneumatically actuated piston, a rack and pinion operatively connected to the rocker arm for rotating the bobbin, and valve means for controlling delivery of pressurized air from a source to the piston to bring the needle bar proximate the bobbin to perform a stitching operation.

12 Claims, 4 Drawing Sheets

PNEUMATIC SEWING MACHINE

SUBJECT MATTER OF THE INVENTION

This invention relates to sewing machines and more particularly to a sewing machine wherein reciprocation of the needle bar and presser foot, rotation of the bobbin and tightening of the thread to set the stitch is achieved entirely through the operation of pneumatically actuated pistons.

BACKGROUND OF THE INVENTION

Sewing machines that rely on means other than an electric motor as a source of motive power for one or all of their functions generally fall into two categories, those that use a hydraulic drive and those that use air pressure. U.S. Pat. No. 4,690,081 discloses a sewing machine that has a separate hydraulic drive for each moving element and the courses of movement of the individual elements are synchronously controlled and adapted to each other by means of a hydraulic pulse generator control unit. Sewing machines of this type are extremely complex devices which require precise, split-second control of each element in conjunction with the others to ensure consistent and uniform sewing results and are primarily used in the garment industry. Other sewing machines, such as, for example, that shown in U.S. Pat. No. 3,353,511, use a pneumatic cylinder and piston to actuate only one element such as the presser foot or, for example, that shown in U.S. Pat. No. 3,913,508 wherein the pistons in pneumatic cylinders are used to drive only the needle bar.

Applicant is unaware of any sewing machine which utilizes separate pneumatically actuated pistons to both reciprocate the needle bar and rotate the bobbin mechanism, lift and lower the presser foot and tighten the thread to set the stitch after it has been formed and coordinate the operation thereof by means of a plurality of mechanically actuated pneumatic valves to achieve a smooth yet forceful stitching operation.

It is, therefore, the primary object of the present invention to provide a completely pneumatic sewing machine.

It is another object of the present invention to provide a sewing machine wherein the needle bar, bobbin mechanism, presser foot and stitch tightening mechanism are all controlled by pneumatically actuated pistons and associated mechanically actuated valves.

It is yet another object of the present invention to provide a pneumatically operated sewing machine which, due to its simple construction, is easy to maintain yet is highly reliable in its operation and relatively inexpensive to manufacture.

It is a still further object of the present invention to provide a pneumatically operated sewing machine that has relatively few moving parts and is devoid of complex gearing associated with electric motor driven sewing machines of the prior art normally associated with the leather fabrication industry.

These and other objects and purposes of this invention will be understood by those acquainted with the design and construction of sewing machines upon reading the following specification and the accompanying drawings.

DETAILED DESCRIPTION OF THE PREFERRED EMBODIMENTS OF THE INVENTION

Figure 1:
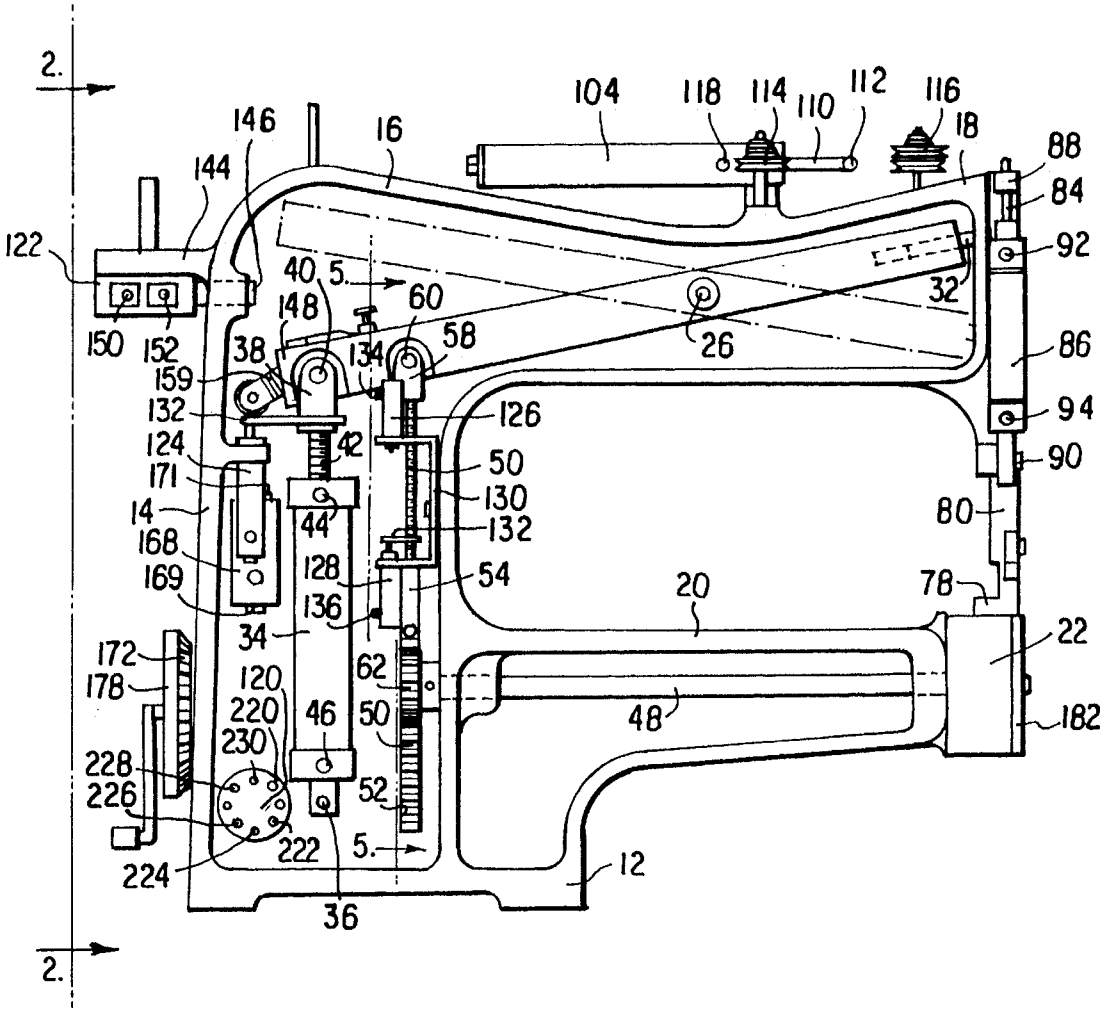
FIG. 1 is a side elevational view of the pneumatic sewing machine of the present invention.
Figure 2:
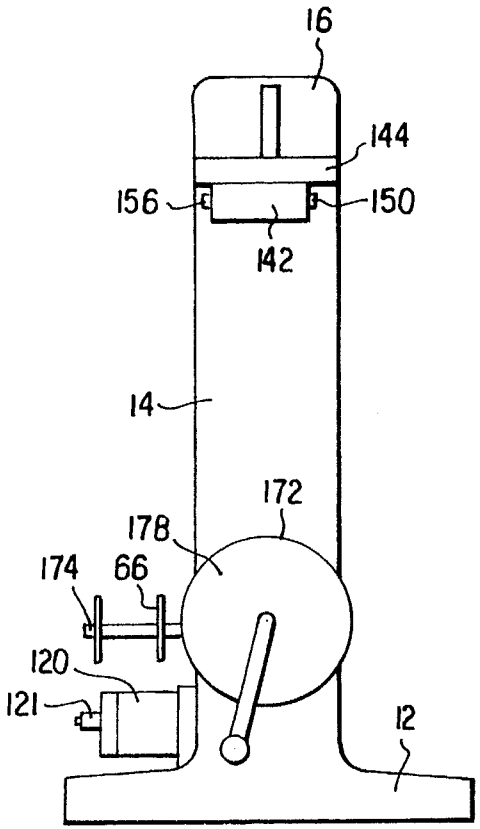
FIG. 2 is an end elevational view taken along the lines 2—2 of FIG. 1.
Figure 5:
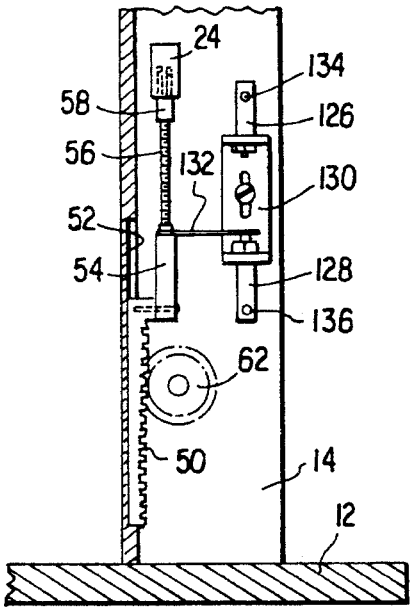
FIG. 5 is a view in partial cross-section taken along the lines 5—5 of FIG. 1.

Referring first to FIGS. 1 and 5, the sewing machine main frame in which the present invention may be incorporated is indicated generally at 10 and comprises a base portion 12, a vertical standard portion 14, an overhanging arm 16 with a needle head 18 at its free end and a horizontally extending work support portion 20 having a shuttle and bobbin assembly 22 on its free end. A rocker arm 24 is mounted on the main frame and fulcrumed on screw 26 for pivotal movement. A needle bar 28 is slidably mounted in a channel 30 in the needle head 18 and is connected to one end of the rocker arm 24 by means of a pin 32 slidable therein and connected to the needle bar 28. A needle bar cylinder 34 is pivotably mounted by screw 36 to the main frame and is pivotably connected to the other end of the rocker arm 24 by means of clevis 38 and pin 40. The clevis 38 is secured to the cylinder piston rod 42 of needle bar cylinder 34. The needle bar cylinder 34 has ports 44, 46 for the supply and venting of air to operate the cylinder, as will be described in more detail later. Sufficient to say at this point that as the needle bar cylinder piston rod reciprocates, the needle bar 28 will also reciprocate up and down via rocker arm 24. A rotatable shuttle drive shaft 48 extends longitudinally within work support arm 20 and is suitably journaled at the end adjacent the shuttle mechanism 22 and at the right wall of the vertical standard 14. A rack 50 is mounted for sliding movement in a channel 52 formed in the vertical standard 14 and is connected by means of bar 54 and threaded rod 56 to clevis 58, which in turn is pivotably connected by pin 60 to rocker arm 24. A pinion gear 62 is secured to one end of the shuttle drive shaft 48 and is in meshing engagement with, and rotatably driven by, the rack 50 as it reciprocates vertically. The shuttle mechanism 22 includes a drive ring 64 that is operatively connected to the other end of the shuttle drive shaft 48 and is caused to rotatably oscillate as the rack 50 causes pinion gear 62 to correspondingly oscillate. The shuttle mechanism 22 is conventional and also includes a bobbin 66.

Figure 3:
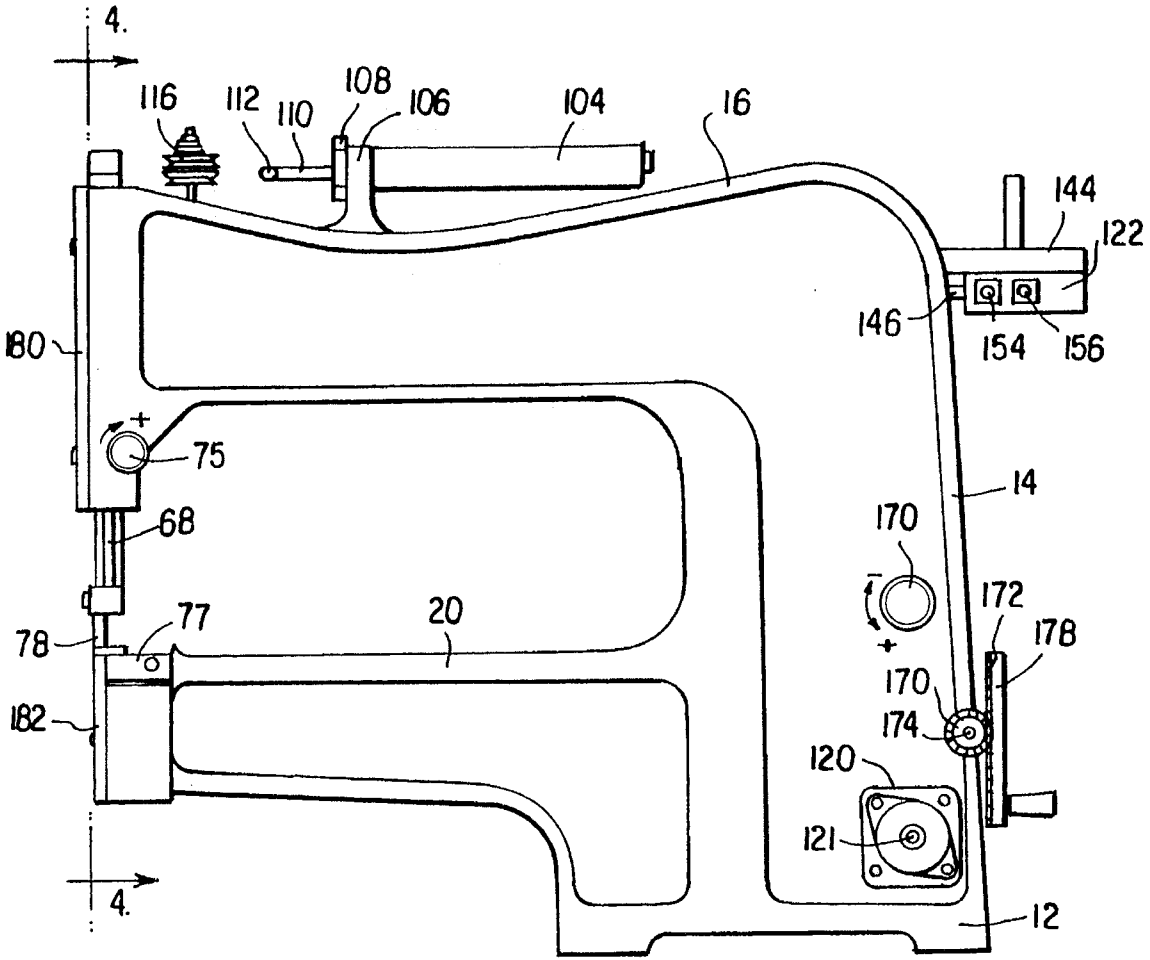
FIG. 3 is an elevational view of the other side of the pneumatic sewing machine of the present invention.
Figure 4:
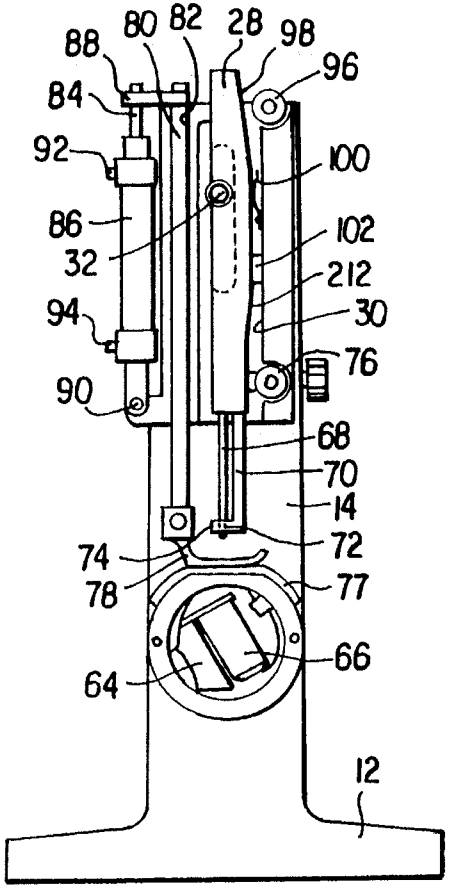
FIG. 4 is an elevational view taken along the lines 4—4 of FIG. 3.

Referring now to FIGS. 3 and 4, a sewing needle 68 is secured to the end of the needle bar 28. A needle foot 70 is also slidably mounted in the end of the needle bar 28, and it has an aperture 72 in the L-shaped end 74 thereof for receiving and guiding the end of the needle 68. The needle bar 28 has a cam surface 74 which engages a rotatably mounted adjustment cam wheel 76. The adjustment cam wheel 76 is movable toward and away from the cam surface 74 by means of a knob 75 secured thereto by means of a threaded shaft 80. As can be seen, as the needle bar 28 reciprocates vertically, the needle 68 will penetrate the work material (not shown) and carry thread from a source to the vicinity of the bobbin 66, whereupon a stitch will be formed in the conventional and well known manner. During the descent of the needle bar 28, the cam surface 74 will engage the cam adjustment wheel 76 and cause the needle bar 28, needle 68 and needle foot 70 to move in a horizontal direction after the needle 68 has penetrated the work material, which in turn causes the work material to be advanced prior to the needle bar 28 lifting the needle 68 from the work. As the needle 68 penetrates the work material, the needle foot 70 engages the work to both hold it and guide and support the needle 68 to thereby ensure even, incremental advancement of the work material corresponding to the desired length of the stitch to be formed. The needle foot 70 is slidably mounted in needle bar 28 as aforementioned and biased away therefrom by a spring (not shown) in the needle bar 28. As the needle foot 70 engages different thicknesses of work material, the L-shaped end 74 engages the work surface during each stitch forming operation causing the foot 70 to slide up into the needle bar 28.

In order to firmly hold the work material against the needle plate 77 during the stitch forming operation, a presser foot 78 is provided secured to one end of a presser foot bar 80 which in turn is mounted for vertical reciprocating movement in a channel 82 formed in the needle head 18. The other end of the presser foot bar 80 is secured to the piston shaft 84 of a presser foot cylinder 86 by means of a connecting plate 88. The presser foot cylinder 86 is secured at one end by bolt 90 to the needle head 18 and has ports 92, 94 for supply and venting of air to operate the cylinder, as will be described in more detail later. A guide roller 96 is also provided which engages cam surface 98 on the needle bar 28 to support it during horizontal movement of the needle bar 28. A leaf spring is mounted in channel 30 and serves to bias the needle bar 28 against the channel wall 30 at the point where the projection 102 is formed on the needle bar 28.

In order to set the stitch in the work material after the stitch has been formed, a pneumatic cylinder 104 is provided mounted on the arm 16 by means of a U-shaped bracket 106 and nut 108. The cylinder 104 has a piston rod 110 with an aperture 112 formed through the end thereof. Thread from a source is passed around tensioner wheels 114, 116 and through aperture 112 before it is passed through the eye of needle 68. A port 118 is provided on the cylinder 104 for supplying air to operate the cylinder, as will be described in more detail later.

In order to control the supply of air to operate the needle bar cylinder 34, presser foot cylinder 86 and thread take-up cylinder 104, a needle cylinder valve 120, a presser foot valve 122 and a thread take-up valve 124, respectively, are provided in addition to pilot sensor valves 126, 128 associated with needle cylinder valve 120. The needle cylinder valve 120 is a four way, double-vent-piloted valve that is operated between two positions. The vent supply pressure is independent of the inlet pressure to the valve, and makes the valve usable as a fully ported, five port valve. An independent pilot supply of air passes through built-in restrictions and pressurizes both pilots. Venting (exhausting) the pressure in one pilot chamber (faster than the restricted supply can recover) causes the valve to be shifted by the opposite pilot. A button 121 is provided on the needle cylinder valve 120 to return the needle bar 28 to its uppermost vertical position when pressed. To supply the pilot, the pilot sensor valves 126, 128 are mounted on the vertical standard 14 by means of a bracket 130 in spaced-apart relationship. A sensor actuator plate 132 is adjustably mounted on the threaded rod 56 and actuates the pilots 126, 128 as the threaded bar 56 reciprocates. The pilot sensor valves 126, 128 have ports 134, 136 for receiving air under pressure from the needle sensor valve 120, as will be described in more detail later, and apertures (not shown) for venting the pressurized air as the pilot sensor valves 126, 128 are actuated by the sensor actuator plate 132. A thread take-up valve 124 is mounted on a bracket 138 adjacent the needle bar 34 and is actuated by a plate 132 secured to piston rod 42 as it reciprocates. The thread take-up valve 124 supplies pressurized air to the thread take-up cylinder 104 through ports 125, 127 of thread take-up valve 124, as will be more fully described later.

To operate the pressure foot cylinder 86, the presser foot valve 122 is mounted on a bracket 144 and has an operating shaft 146 extending through the vertical standard 14 and biased to a position adjacent the path of the end 148 of rocker arm 24. The valve 122 has ports 150, 152, 154 and 156 for supplying and venting air from presser foot cylinder 86, as will be more fully described later. Actuation of the operating shaft 146 will now be described in conjunction with FIGS. 6A through 6E. The end 148 of the rocker arm 24 is provided with an actuator cam wheel 158 which is rotatably mounted on one end of a cam arm 159. The other end of the cam arm 159 is retained in a slot 162 in the end 148 by means of a pin 160 about which the arm can rotate. The cam arm 159 assumes the position shown in FIG. 6A by gravity and rests against a wall 164 of the slot 162.

Figure 6A:
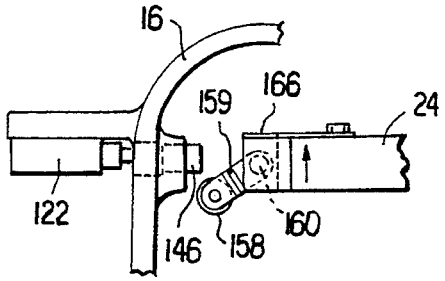
FIGS. 6A through 6E illustrate the sequential operation of the presser foot cam and presser foot valve cam button.
Figure 6B:
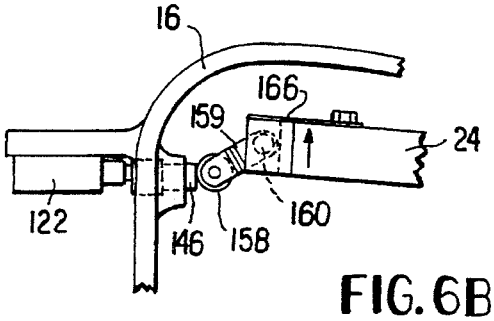
Figure 6C:
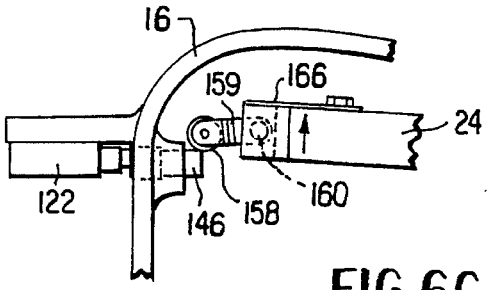
Figure 6D:
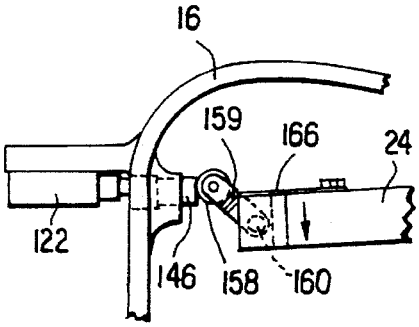
Figure 6E:
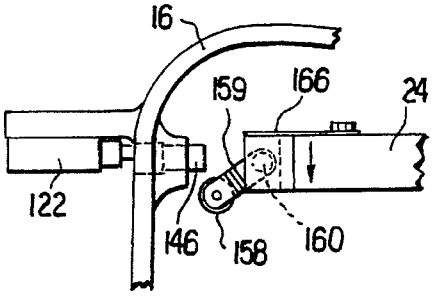

As end 148 of the rocker arm 24 begins to ascend from its position shown in FIG. 6A, the cam wheel 158 begins to engage the end of shaft 146. As shown in FIG. 6B, as the end 148 continues its ascent, the cam wheel 158 causes the shaft 146 to move to a position where it actuates the presser foot valve 122 to supply air to operate the pressure foot cylinder 86. When the end 148 is at the height of its ascent, as shown in FIG. 6C, the end of the shaft 146 is caused to return to its fully extended position. Then, as the end 148 begins its descent, as shown in FIG. 6D, the cam arm 159 rotates about pin 160 in slot 162 and the cam wheel 158 rolls over the end of extended shaft 146 against the influence of leaf spring 166. As the cam wheel 158 clears the shaft 146, as shown in FIGS. 6E, it returns by gravity to its initial position, as shown in FIG. 6A, and the process is repeated each time the rocker arm end 148 is reciprocated past the shaft 146.

A control valve 168 is provided to regulate the amount of pressurized air supplied to the sewing machine to control the overall speed of the sewing operation. The valve 168 has a knob 170 attached thereto which can be manually rotated. A bobbin winder 172 is mounted on the frame 10 and consists of shaft 174 on which the empty bobbin 66 can be inserted. The bobbin 66 engages a gear 176 which is in meshing engagement with a manually rotatable gear 178 also mounted on the frame 10. Cover plates 180, 182 are provided to enclose the needle head 18 and shuttle mechanism 22, respectively.

Figure 7:
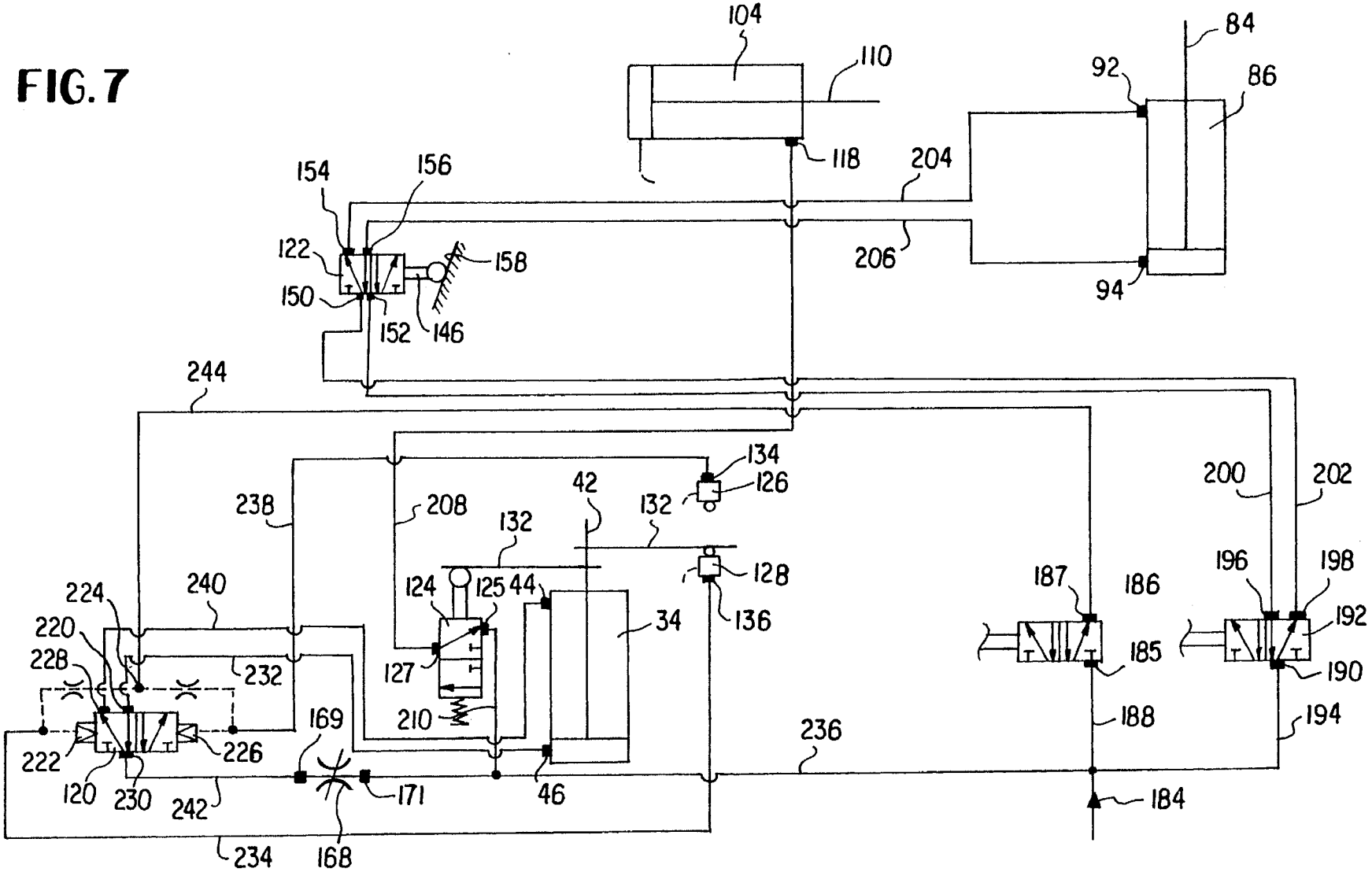
FIG. 7 is a schematic of the manner in which the various pneumatic elements of the sewing machine of the present invention are interconnected by air hoses.

Referring now to FIG. 7, a schematic illustration of the interconnection between the needle bar cylinder 34, pressure foot cylinder 86, and thread take-up cylinder valve 124 and needle cylinder valve 122, presser foot valve 142 and thread take-up cylinder valve 124, respectively. The actual tubing which interconnects the aforementioned cylinders and valves has been eliminated from FIGS. 1 and 3 in the interest of clarity but is shown in FIG. 7 in schematic form. Pressurized air from a source 184 is fed to port 185 of a main foot pedal valve 186 by means of line 188 and to port 190 of a pressure foot pedal valve 192 by means of line 194. The presser foot pedal valve 192 also have ports 196 and 198 which are connected by lines 200 and 202, respectively, to ports 152 and 150 of presser foot valve 122. Ports 154 and 156 are connected by lines 204, 206, respectively, to ports 92, 94 of presser foot cylinder 86. Port 118 of thread take-up cylinder 104 is connected to port 127 of thread take-up cylinder valve 124 by means of line 208. Port 125 is connected to pressurized air source 184 by means of line 210.

Port 220 of needle cylinder valve 120 is connected by line 232 to port 46 of needle bar cylinder 34, port 222 thereof is connected to port 136 of presser sensor valve 128 by line 234, port 224 thereof is connected to port 187 of foot pedal valve 186 by line 244, port 226 thereof is connected to port 134 of presser sensor valve 126 by line 238, port 228 thereof is connected to port 44 of needle bar cylinder 46 by line 240, port 230 thereof is connected to port 169 of control valve 168 by line 242, and port 171 of control valve 168 is connected to the source of pressurized air 184 by line 236.

OPERATION

When the main foot pedal valve 186 is depressed, air is supplied to the pilot sensors on the needle cylinder valve 120. Because the lower pilot valve 128 is engaged by the pilot sensor actuator plate 132 connected to the shuttle rack 50, the needle cylinder valve 120 reverses which starts the needle bar cylinder piston rod 42 in the upward direction. As the needle cylinder piston rod 42 starts upward, the valve actuator plate 132 connected to the piston rod 42 of the needle bar cylinder 34 disengages the thread take-up cylinder valve 124 allowing the thread to move freely.

As the needle bar cylinder piston rod 42 is moved upward, it pushes the needle bar 28 downward via rocker arm 24 driving the needle 68 through the work material and at the same time the shuttle rack 50 turns the shuttle mechanism 22 in the counter-clockwise direction. Once the needle 68 passes through the work material, the cam rod 158 on rocker arm 24 engages the presser foot automatic valve operator shaft 146. This causes the presser foot 78 to rise allowing the work material to move. As the tip of the needle 68 passes through the work material, a ramp 212 on the needle bar 28 engages with adjustment roller 76 pushing the lower part of the needle bar 28 and needle foot 74 indexing the work material. Next, the cam rod 158 on rocker arm 24 disengages with presser foot valve operator shaft 146 allowing the presser foot 78 to return back down to hold the work material. The sensor actuator plate 132 then engages the upper pilot sensor 126 reversing the needle cylinder valve 120 sending the needle cylinder piston rod 42 in the downward direction. The shuttle rack 50 now drives the shuttle mechanism 22 in the clockwise direction allowing the shuttle 64 to loop the thread brought through the material by the needle 68, passing the bobbin 66 through this loop creating a stitch of the lock-type. The needle 68 is then pulled back out of the work material and returned to its upward position.

Just before the needle cylinder piston rod 42 returns to the downward position, the valve actuator plate 132 engages the thread take-up cylinder valve 124 which retracts the thread take-up cylinder piston rod 110 and thereby takes up all the extra thread and sets the stitch. In the final step in the cycle, the needle cylinder piston rod 42 returns to the downward position and the pilot sensor actuator plate 132 engages the lower pilot sensor 128. If the foot pedal valve 186 is disengaged prior to this step, the machine will stop; if not, it will continue to cycle performing a continuous stitching operation. Any time the foot pedal valve 186 is disengaged, the machine continues on its cycle until the pilot sensor actuator plate 132 engages either of the pilot sensors 126, 128 whereupon the machine will stop at this point.

Applicant has described in detail his novel pneumatic sewing machine apparatus. It is apparent that many modifications and variations of this invention as hereinbefore set forth may be made without departing from the spirit and scope thereof. The specific embodiments described are given by way of example only, and the invention is limited only by the terms of the appended claims.

What I claim is:

1. A sewing machine comprising:

a) a main frame housing, a presser foot means and a needle bar means mounted in said housing for reciprocatory movement and a shuttle means mounted in said housing for rotary movement, said needle bar means having needle and thread means carried thereby, b) rocker arm means pivotably mounted in said housing and having one end thereof attached to said needle bar means and the other end thereof attached to first pneumatically actuated cylinder means to cause said reciprocatory movement of said needle bar means, c) means for rotating said shuttle means, d) valve means for controlling the delivery of pressurized air from a source to said first cylinder means to thereby bring said needle and thread means proximate said rotating shuttle means to perform a stitching operation, and e) second pneumatically actuated cylinder means operatively connected to said presser foot means to cause reciprocatory movement thereof in response to said pressurized air from said valve means.

2. A sewing machine as set forth in claim 1 further comprising third pneumatically actuated cylinder means having rod means operatively connected to said thread for tightening said thread after each stitch has been formed during said stitching operation.

3. A sewing machine as set forth in claim 2 wherein said valve means includes:

a) thread tightening valve means for controlling actuation of said thread tightening cylinder means, and b) means operatively connected to said rocker arm means to actuate said thread tightening valve means.

4. A sewing machine as set forth in claim 1 wherein said valve means includes:

a) needle bar valve means having a first position for controlling actuation of said needle bar cylinder means in a first direction and a second position for controlling actuation of said needle bar cylinder means in a second direction, b) pilot sensor valve means for controlling movement of said needle bar valve means between said first and second positions, and c) means operatively connected to said rocker arm means for actuating said pilot sensor valve means.

5. A sewing machine as set forth in claim 4 further comprising pedal actuated valve means for controlling the flow of pressurized air from said source to said needle bar valve means.

6. A sewing machine as set forth in claim 1 further comprising:

a) presser foot valve means having a first position for controlling actuation of said presser foot cylinder means in a first direction and a second position for controlling actuation of said presser foot cylinder means in a second direction, and b) means on said rocker arm to cause said presser foot valve means to move from said first position to said second position.

7. A sewing machine as set forth in claim 6 wherein said means on said rocker arm is a resettable cam means.

8. A sewing machine as set forth in claim 6 further comprising pedal actuated valve means for controlling the flow of pressurized air from a source to said presser foot valve means.

9. A sewing machine as set forth in claim 1 wherein said means for rotating said shuttle means is a rack pivotably mounted to said rocker arm means for reciprocatory movement thereby and said shuttle means is operatively connected to a pinion in meshing engagement with said rack.

10. A sewing machine as set forth in claim 9 wherein said means for actuating said pilot sensor valve means is a lever means operatively connected to said rack.

11. A sewing machine comprising:

a) a main frame housing, a presser foot means and needle bar means mounted in said housing for reciprocatory movement and shuttle means mounted in said housing for rotary movement, said needle bar means having a sewing needle attached thereto for bringing thread from a source to the vicinity of said shuttle means to form a stitch as said shuttle rotates, b) rocker arm means pivotably mounted on said housing and having one end thereof attached to said needle bar means and the other end thereof attached to a first pneumatically actuated cylinder means to cause said reciprocatory movement of said needle bar means, c) means operatively connected to said rocker arm means for rotating said shuttle means, d) a second pneumatically actuated cylinder means operatively connected to said presser foot means to cause said reciprocatory movement thereof, e) a third pneumatically actuated cylinder means having rod means operatively connected to said thread for tightening said thread after said stitch has been formed, and f) valve means for controlling pressurized air to said first, second and third pneumatically actuated cylinder means to cause sequential operation thereof to perform a stitching operation.

12. A sewing machine comprising:

a) a main frame housing, a needle bar means mounted in said housing for reciprocatory movement, and a shuttle means mounted in said housing for rotary movement, said needle bar means having needle and thread means carried thereby, b) rocker arm means pivotably mounted in said housing and having one end thereof attached to said needle bar means and the other end thereof attached to pneumatically actuated cylinder means to cause said reciprocatory movement of said needle bar means, c) means for rotating said shuttle means, and d) valve means actuated by movement of said rocker arm means for controlling the delivery of pressurized air from a source to said cylinder means to thereby bring said needle and thread means proximate said rotating shuttle means to perform a stitching operation.

* * * * *